US006339635B1

(12) United States Patent
Schardt et al.

(10) Patent No.: US 6,339,635 B1
(45) **Date of Patent: *Jan. 15, 2002**

(54) X-RAY TUBE

(75) Inventors: Peter Schardt, Roettenbach; Erich Hell; Detlef Mattern, both of Erlangen, all of (DE)

(73) Assignee: Siemens Aktiengesellschaft, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/266,092

(22) Filed: Mar. 10, 1999

(30) Foreign Application Priority Data

Mar. 10, 1998 (DE) ..... 198 10 346

(51) Int. Cl.[7] ..... H01J 35/30
(52) U.S. Cl. ..... 378/137; 378/113
(58) Field of Search ..... 378/137, 138, 378/113

(56) References Cited

U.S. PATENT DOCUMENTS 4,607,380 A 8/1986 Oliver
4,993,055 A 2/1991 Rand et al.
5,822,395 A * 10/1998 Schardt et al. ..... 378/137

FOREIGN PATENT DOCUMENTS

DE OS 34 01 749 1/1985
DE OS 196 31 899 12/1998

* cited by examiner

*Primary Examiner*—Craig E. Church
(74) *Attorney, Agent, or Firm*—Schiff Hardin & Waite

(57) ABSTRACT

An x-ray tube has a vacuum housing containing a cathode arrangement that emits electrons and an anode having a target surface on which the electrons, accelerated by an electrical field and forming an electron beam strike in a focal spot, and having a quadrupole magnet system including a coil, for focusing and deflection of the electron beam. A control unit is connected to the quadrupole magnet system. The control unit is supplied with, or has stored therein various parameter sets of predetermined coil currents that can be activated, so that, dependent on the respective parameter set, the focal spot can be displaced discretely in azimuthal fashion onto particular locations of the target surface of the anode.

7 Claims, 5 Drawing Sheets

X-RAY TUBE

BACKGROUND OF THE INVENTION

1. Field of the Invention

The present invention is directed to an x-ray tube of the type having a vacuum housing, a cathode arrangement in the housing that emits electrons and an anode in the housing with a target surface on which the electrodes, accelerated by an electrical field and forming an electron beam, are incident in a focal spot, and having a quadrupole magnet system, including a coil, for the focusing and deflection of the electron beam.

2. Description of the Prior Art

An x-ray tube of the above general type is known for example from German OS 196 31 899. X-ray tubes of this type of construction, or of a comparable type of construction, are used both in medicine and outside of medicine, e.g. for material examinations.

Medical areas of application of x-ray tubes of this type are, for example, in the fields of neuroradiography, general angiography and cardiology. In comparison to other medical areas of application, these medical areas of application are distinguished in that a spatial perception (i.e., an image with depth), for example, the path of vessels, in the body of a patient to be examined is desired, which can be achieved by means of stereo exposures of the relevant body area of the patient. The term "stereo exposures," as used herein means that the body region to be examined is irradiated from at least two different x-ray projection angles one after the other, and the results are displayed on a divided image reproduction device or on two image reproduction devices. In the observation of the items of the image information shown on a divided image reproduction device or on two image reproduction devices, a spatial impression is seen by a viewer.

It is known to execute such stereo exposures a) with an x-ray tube R1 that is displaced in linear fashion between two positions (cf. FIG. 1*a*), b) with an x-ray tube R2 that is rotated around a point of rotation (cf. FIG. 1*b*), c) with two x-ray tubes R3, R4 (cf. FIG. 1*c*) arranged next to one another, or d) with a multi-cathode x-ray tube R5, having, for example, three cathodes K1, K2, K3 (cf. FIG. 1*d*).

Solutions a) and b) have the disadvantage that the image exposure frequency is too low for x-ray motion picture (ciné) exposures. Solution c) has the disadvantage that it is expensive due to requiring two x-ray tubes, and the stereo basis, i.e., the spacing of the foci of the x-ray tubes, is too large. Solution d) is indeed suitable for all application techniques in stereo exposures, but the construction of the x-ray tube with respect to the multi-cathode arrangement is technically complicated and thus expensive.

From U.S. Pat. No. 4,993,055, a rotating tube is known in which two focal spots can be produced, so that the rotating tube is also suitable for stereo exposures. In order to deflect the electron beam running from the cathode to the anode, the rotating tube has two groups of two magnet coils (i.e., tow magnet coils per group) opposed to one another that produce a substantially homogenous magnetic field. The groups of magnet coils are arranged so as to be offset from one another by a particular angle of rotation, the angle of rotation substantially corresponding to the angle at which the two focal spots are offset. Given activation of one group of coils, the electron beam is thus deflected onto one focal spot, and given activation of the other group of coils, it is deflected onto the other focal spot.

A disadvantage of this known system is that a pair of coils is required for each displacement of the focal spot, making the construction of the rotating tube, in particular relating to the arrangement of the magnet coils, relatively expensive.

From U.S. Pat. No. 4,607,380, an x-tube is known with two magnets arranged one after the other, of which one magnet serves for the deflection of the electron beam and the other for the focusing of the electron beam.

In German OS 34 01 749, an x-ray tube is disclosed that has deflecting electrodes, arranged one after the other, for an electron beam.

SUMMARY OF THE INVENTION

An object of the present invention is to provide an x-ray tube of the type initially described wherein the focal spot of the x-ray tube can be displaced and the x-ray tube is technically simple to manufacture and is of an economical construction.

According to the invention, this object is achieved in an x-ray tube with a vacuum housing containing a cathode arrangement that emits electrons and an anode with a target surface on which the electrons, accelerated by an electrical field and forming an electron beam, are incident in a focal spot, and having a quadrupole magnet system, including a coil, for the focusing and deflection of the electron beam, and a control unit allocated to the quadrupole magnet system, with which several different parameter sets of coil currents can be stored and activated, the coil current sets being predetermined to cause the focal spot to be displaced in azimuthal fashion onto particular locations of the target surface of the anode, depending on the parameter set which is activated. The x-ray tube thus has only a single quadrupole magnet system, provided both for focusing and for deflecting the electron beam. The control unit allocated to the quadrupole magnet system makes it possible, by predetermination, storing and activation of various parameter sets of coil currents for the coils of the quadrupole magnet system, to displace the focal spot of the x-ray tube discretely, in azimuthal fashion, onto particular locations of the target surface of the anode, while maintaining the relative position of the quadrupole magnet system to the x-ray tube. A dipole field that serves for the deflection of the electron beam is thereby superposed or a quadrupole field that serves for the focusing of the electron beam, the quadrupole field being produced by coil current components that are substantially equal in magnitude, and the dipole field is produced, according to the desired position of the focal spot, by coil current components whose magnitudes are not necessarily equal. The coil current components are respectively added to one another to form a total coil current allocated to a coil of the quadrupole magnet system. Given a quadrupole magnet system with four coils, four coil currents, each individually allocated to one coil of the quadrupole magnet system, form a parameter set for the production of a particular focal spot. Due to the use of only one quadrupole magnet system provided with a control unit for the focusing and deflection of the electron beam, the inventive x-ray tube is of relatively simple construction, and thus can be manufactured in a cost-advantageous manner.

In a preferred embodiment of the invention the x-ray tube has at least one coil connected spatially downstream from the quadrupole magnet system, and with this coil a magnet field can be produced with which the shape of the focal spot and its orientation relative to the target surface of the anode can be influenced. The coil can be a solenoid. The magnetic field produced by the solenoid serves to influence the electron beam after this beam has traversed the magnetic field of the quadrupole magnet system, i.e., the quadrupole field and dipole field are superimposed. This is because in many parameter sets of coil currents that effect a particular deflection of the electron beam onto an azimuthally displaced focal spot of the anode, due to non-homogeneities of the resulting magnetic field at the location at which the electron beam passes through the magnetic field of the quadrupole magnet system an undesired spreading of the electron beam results and thus an undesired spreading of the displaced focal spot would occur, and the resolution capacity of an x-ray exposure would be degraded. This undesired spreading of the focal spot can be counteracted by means of a suitable magnetic field that influences the electron beam, so that a focal spot of the desired length and width advantageously arises on the target surface of the anode. There is also the possibility of rotating the focal spot under the influence of the magnetic field, i.e., modifying the orientation of the focal spot relative to the target surface so that, given a displaced focal spot, the focal spot can always be oriented in such a way that x-ray exposures with high resolution capacity can be produced.

If the inventive x-ray tube is, for example, a fixed-anode x-ray tube or a rotating-anode x-ray tube, provided for stereo exposures of subjects or for material investigations, then according to a further version of the invention the vacuum housing of the x-ray tube can have at least two radiation exit windows respectively allocated to different focal spots. An inventive x-ray tube with several (e.g. four) beam exit windows, each allocated to a focal spot, is for example of great interest for industrial diagnostic purposes, e.g. checking soldered connections on circuit boards, since with only one such x-ray tube in a test stand test samples can continuously be supplied to the test stand from several sides, namely the x-ray exit sides of the x-ray tube, and the test samples can be irradiated, i.e. tested, one after the other in a very short time, with the focal spot being azimuthally displaced corresponding to the defined position of the test sample relative to the x-ray tube.

In a further embodiment of the invention the vacuum housing has an annular beam exit window. This is preferably the case if the x-ray tube is a rotating tube, i.e., the vacuum housing of the x-ray tube can be rotated around an axis, with the cathode arrangement and the anode are respectively connected fixedly with the vacuum housing. The inventive construction of such a rotating tube with a quadrupole magnet system having a control unit for the displacement of a focal spot, the rotating tube, can be used for stereo exposures of subjects.

DESCRIPTION OF THE PREFERRED EMBODIMENTS

Figure 1A:
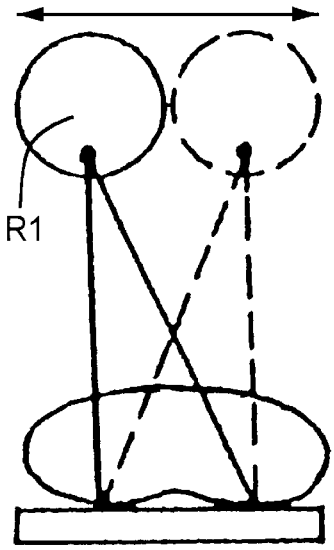
FIGS. 1*a*, 1*b*, 1*c* and 1*d*, as noted above, show known arrangements of x-ray tubes for x-ray stereo exposures.
Figure 1B:
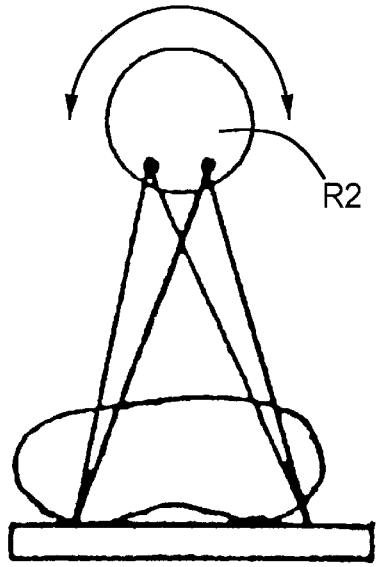
Figure 1C:
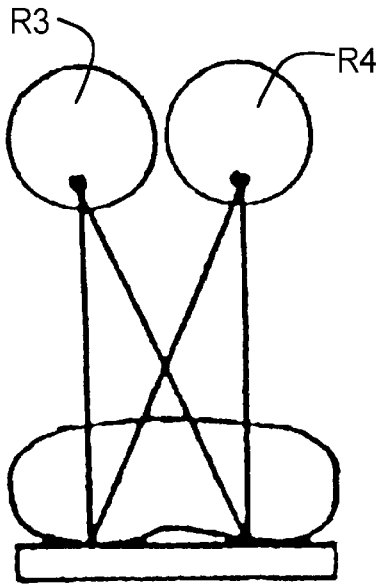
Figure 1D:
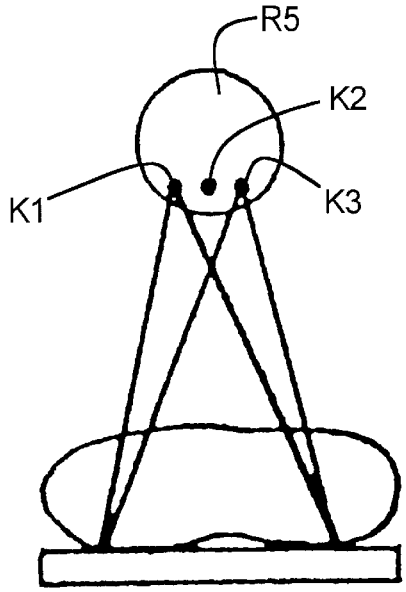
Figure 2:
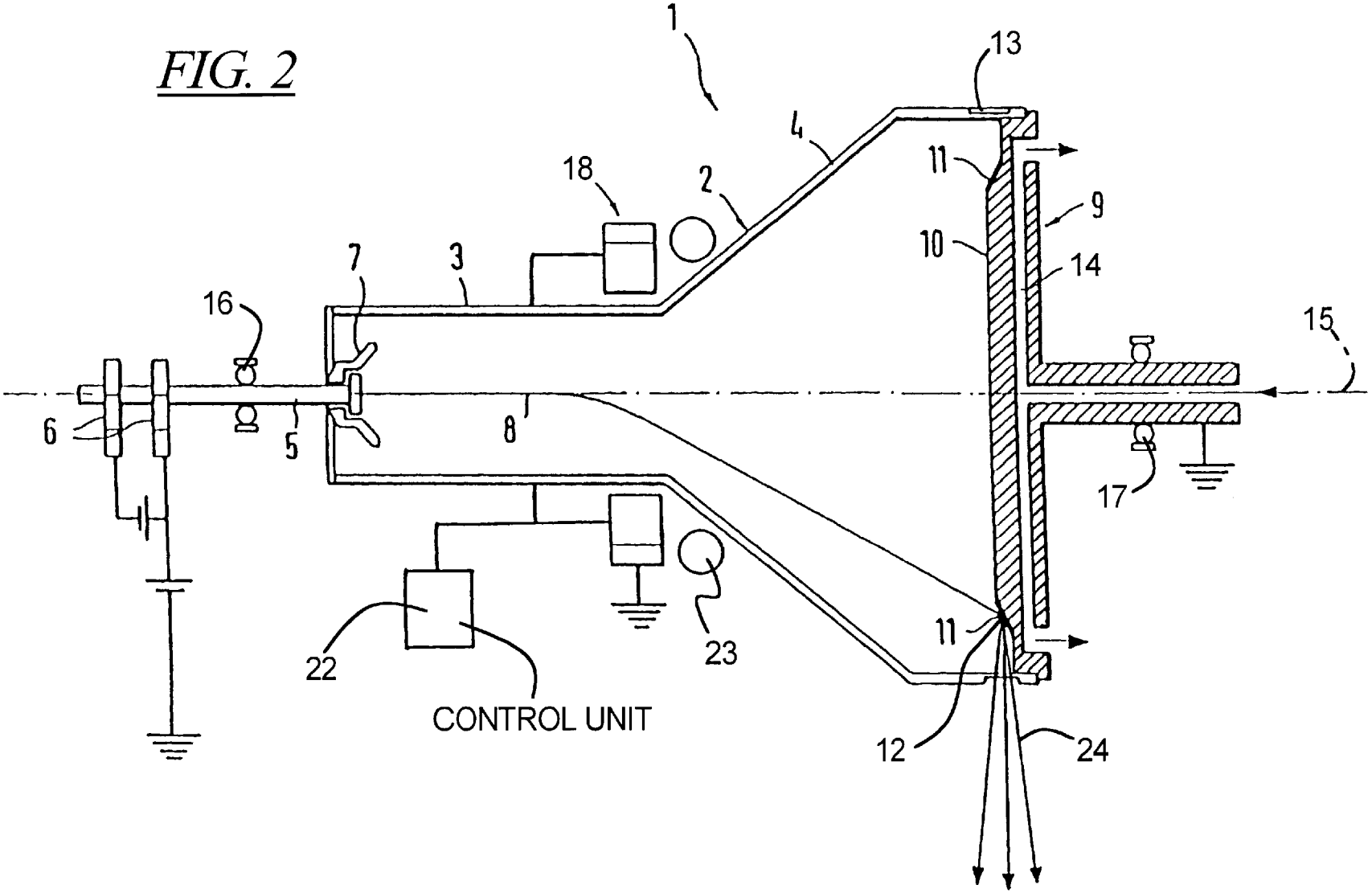
FIG. 2 is a schematic representation of an inventive rotatable x-ray tube.

FIG. 2 shows an x-ray tube 1 having a piston-shaped vacuum housing 2 with a substantially cylindrical region 3 and a segment 4 connected thereto that expands in the shape of a truncated cone.

A cathode arrangement 5 is arranged at the one end of the vacuum housing 2, which arrangement includes, in the present embodiment, an electron emitter with which during operation of the x-ray tube 1 an electron beam 8 with a substantially round cross section can be produced. In the present embodiment, the cathode arrangement 5 is connected with a suitable energy source via slip rings 6, in order to be applied to negative potential. A focusing electrode 7, which serves for the adjustment of the surface size of the electron beam 8, is allocated to the cathode arrangement 5.

The other end of the vacuum housing 2 is provided with an anode 9. The anode 9 has an anode plate 10 with a target surface 11, which in the present embodiment is filled with tungsten and on which the electron beam 8 strikes in a focal spot 12 in order to produce x-rays 24. The x-rays 24 exit the vacuum housing 2 of the x-ray tube 1 through an annular beam exit window 13.

In the present embodiment, the anode 9 is provided in its interior with channels 14 in order to enable the entry and exit of a coolant, which is required in order to carry away the thermal energy that arises during the production of the x-rays 24. The anode 9 need not necessarily contain such channels 14 for the supply of coolant, but instead, for example, can be charged directly with a coolant. The anode 9 itself is at ground potential or at positive high voltage, so that an electrical field arises between the cathode arrangement 5 and the anode 9, this field serving for the acceleration of the electrons emitted by the cathode arrangement 5 in the direction toward the anode 9.

The cathode arrangement 5 and the anode 9 are arranged along an axis 15, around which the vacuum housing 2 can be rotated. In order to enable rotation of the vacuum housing 2, the cathode arrangement 5, connected fixedly with the vacuum housing 2, and the anode 9, connected fixedly with the vacuum housing 2, are rotatably mounted with bearing elements 16, 17. The rotation of the x-ray tube 1 is brought about with a suitable, known drive means (not shown).

In the production of x-rays 24, the electron emitter of the cathode arrangement 5 is heated to its emission temperature, which causes electrons to be emitted therefrom. As a result of the electrical field that prevails between the cathode arrangement 5 and the anode 9, the emitted electrons, in the form of the depicted electron beam 8, are accelerated in the direction of the anode 9. Since the electron beam 8 propagates along the field lines of the electrical field in the direction toward the anode 9, a quadrupole magnet system 18 that serves for focusing and deflection, and which is described in more detail below, is provided for the deflection of the electron beam 8 onto the target surface 11 of the anode 9, whereby x-rays 24 are produced when the electron beam 8 strikes in the focal spot 12 on the target surface 11. Because the quadrupole magnet system 18 is stationary in relation to the rotating vacuum housing 2, the electron beam 8 is always deflected equally (downwardly in the example shown) corresponding to the Lorentz $\vec{v} \times \vec{B}$ force and is always incident on the target surface 11 of the rotating anode 9. The quadrupole magnetic system 18 serves not only for the deflection of the electron beam 8, but also for the focusing of the electron beam 8, in order to be able to set a line-shaped focal spot 12 on the impinge surface 11 of the anode 9 in the present embodiment.

Figure 3:
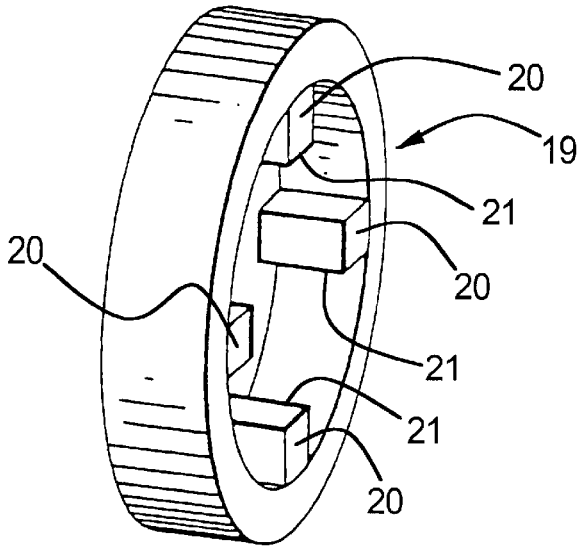
FIG. 3 is a perspective view of the coil support with coils arranged thereon, for use in the inventive x-ray tube.

FIG. 3 shows in detail, in a perspective view, the quadrupole magnet system 18 that serves for the deflection and focusing of the electron beam 8. The quadrupole magnet system 18 includes an annular carrier 19, which in the present embodiment is an iron yoke. The carrier 19 is provided on its inner side with a total of four pole projections 20 that project radially. The pole projections 20 are spaced uniformly to one another at respective angle of approximately 90°. The cross-sectional shape of the pole projections 20 is substantially rectangular in the present embodiment. The spacing of the pole projections 20 located opposite one another is dimensioned in such a way that it corresponds approximately to the outer diameter of the cylindrical region 3 of the vacuum housing 2 of the x-ray tube 1, because the carrier 19 is arranged around this region 3.

Coils 21, shown only as an example in FIG. 3, are respectively arranged on the pole projections 20. Current flows through the coils 21, which can consist of a single winding, and these coils produce the magnetic field that serves for the deflection and focusing of the electron beam 8. The quadrupole magnet system 18 is thus a magnet system that is of simple construction and is easy to operate. The carrier 19 is arranged on a suitable mount (not shown in the figures) that holds the quadrupole magnet system 18 still in relation to the x-ray tube 1, this mount, for example, being a part of a mounting housing that receives the entire x-ray tube 1. As an alternative to the one-piece construction, shown in FIG. 3, of the carrier 19, the carrier 19 can for example be formed by two parts that are fastened detachably to one another, so that the annular carrier 19 can be opened and the two half shells can easily be placed around the region 3 of the vacuum housing 2.

Figure 4:
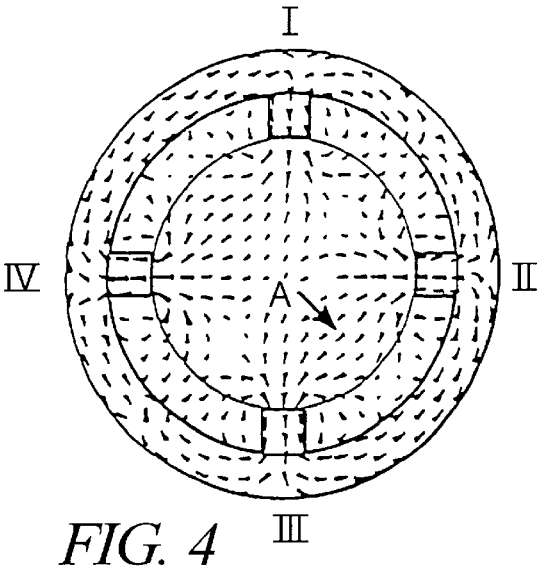
FIG. 4 illustrates the dipole components of the magnetic field produced in the inventive x-ray tube.
Figure 5:
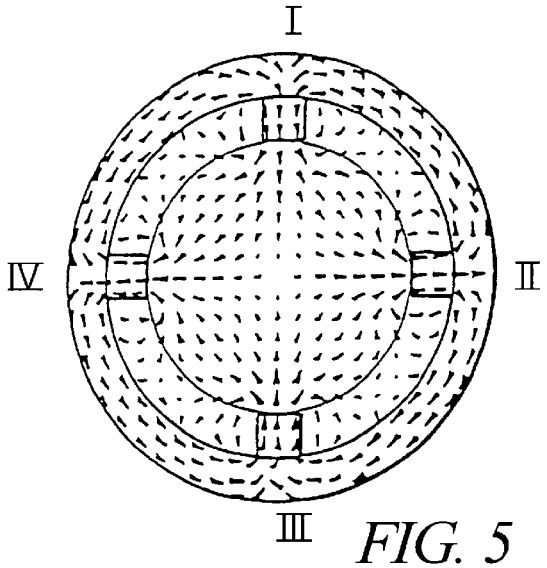
FIG. 5 illustrates the quadrupole component of the magnetic field produced in the inventive x-ray tube.
Figure 6:
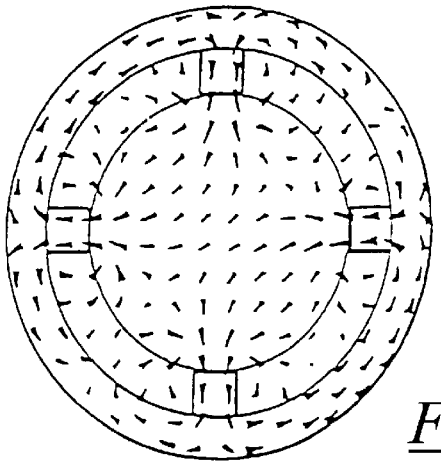
FIG. 6 shows the resulting field given superimposition of the two field components of FIGS. 4 and 5.

FIGS. 4 to 6 show the individual field components of the magnetic field that result from the quadrupole operation, and the superimposition thereof to form the resulting magnetic field. For this purpose, each coil 21 of the quadrupole magnet system 18 is charged with a coil current, resulting from the combination of several coil current components, in order to produce the resulting magnetic field.

FIG. 4 shows the dipole component of the magnetic field that can be produced with the quadrupole magnet system 18, this component result (theoretically) from the charging of each coil 21 with a corresponding coil current component. As can be seen in FIG. 4, four magnet poles I, II, III and IV are formed, as results already from FIG. 3. For the dipole portion of the magnetic field, the poles I and 11 respectively form the north pole, and the poles III and IV respectively form the south pole. This is reflected in the field curve, indicated in graphic form. The dipole portion of the magnetic field serves for the deflection of the electron beam 8. According to the field lines shown in FIG. 4, the electron beam 8 would be deflected in the direction of the arrow A.

FIG. 5 shows the quadrupole portion of the magnetic field that results due to the asymmetrical operation of the coils 21, with each coil 21 of the quadrupole magnet system being (theoretically) charged with a coil current that is equal in magnitude in order to produce the quadrupole portion of the magnetic field. In the case of the quadrupole portion of the magnetic field, the poles I and III are the respective north pole, and the poles II and IV are the south pole. This is also indicated by the specific field lines. The quadrupole portion of the magnetic field hereby has a characteristic (and the focusing effect results from this) so that it defocuses the electron beam 8 in the direction of deflection, i.e., the electron beam 8 is spread in the direction of the arrow A in FIG. 4. In contrast, the electron beam 8 is collimated in the direction perpendicular thereto; its width thus reduces. In this way, the setting of a line focus is possible. The surface area of the electron beam 8, or of the focal spot 12, does not change; only the ratio of length to width changes. The size itself can be adjusted only by means of the focusing electrode 7.

By the superimposition of the coil current components for the production of the dipole field and the coil current components for the production of the quadrupole field, different total coil currents result for the coils 21, so that, given charging of the coils 21 with the corresponding resulting coil currents, a resulting magnetic field (shown in FIG. 6) arises that serves for the deflection and focusing of the electron beam 8.

In order to enable use of the x-ray tube 1 for x-ray stereo exposures of a subject, for example of a patient (not shown in the figures), e.g. for neural radiography, general angiography, or cardiology, in which exposures the bodily regions of the patient that is to be examined are transilluminated from at least two different x-ray projection angles in succession, a control unit 22 is connected to the quadrupole magnet system 18 of the x-ray tube 1. The control unit 22 includes, for example, input units, computing units and memory units (not shown in more detail) and at least one current source. A current source is preferably provided for each coil 21 of the quadrupole magnet system 18. Via the input unit of the control unit 22, parameter sets of four (in the present embodiment) coil currents, which produce a magnetic field given corresponding charging of the coils 21, which causes an azimuthal displacement of the focal spot 12, can be predetermined and stored in the memory unit of the control unit 22. According to the input, e.g. by a user or by the execution of a corresponding operating program, the computing unit of the control unit 22 can drive the current sources of the control unit 22 in such a way that each coil 21 of the quadrupole magnet system 18 is charged with a corresponding current, provided for the respective coil 21, of a parameter set for the production of a defined magnetic field for the deflection of the electron beam 8 onto a particular focal spot on the target surface 11 of the anode 9. The control unit 22 can even be operated in such a way that the focal spots between two or more locations on the target surface 11 of the anode 9 can be displaced discretely in a time-dependent fashion, for example periodically.

Figure 7:
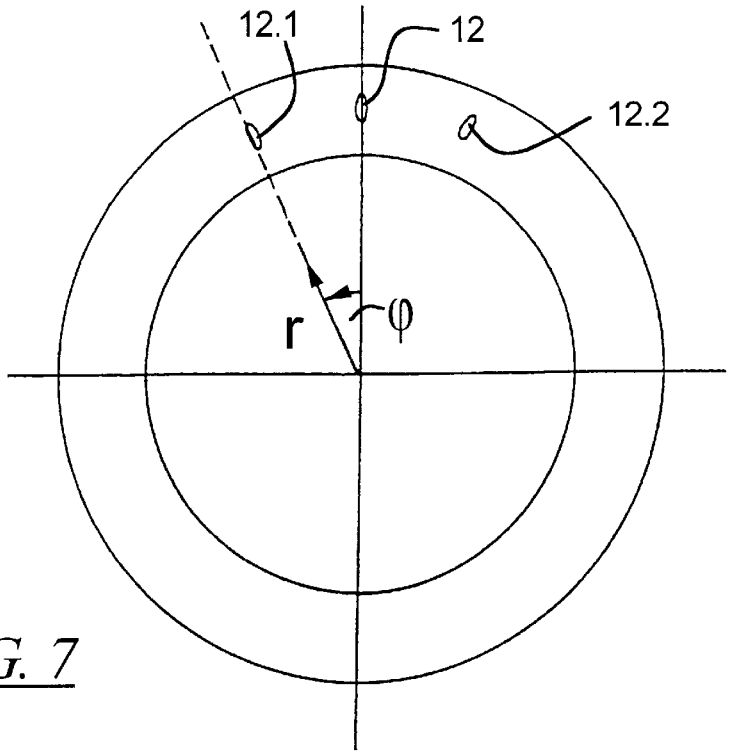
FIG. 7 shows the positions of three focal spots that can be produced on the target surface of the anode in the inventive x-ray tube.

FIG. 7 shows an example of the azimuthal displacement of the focal spot 12 so as to produce focal spots 12.1 and 12.2. In the production of each of the three focal spots 12, 12.1 and 12.2, the coils 21 of the quadrupole magnet system 18 are charged respectively with three different parameter sets, each set causing the generation of four coil currents. FIG. 7 is plotted in a polar coordinate system.

Thus dependent on different parameter sets of coil currents with which the coils 21 of the quadrupole magnet system 18 are charged, the focal spot 12 can be discretely azimuthally displaced to particular locations, i.e., to other focal spots 12.1, 12.2 of the target surface 11 of the anode 9.

Figure 8:
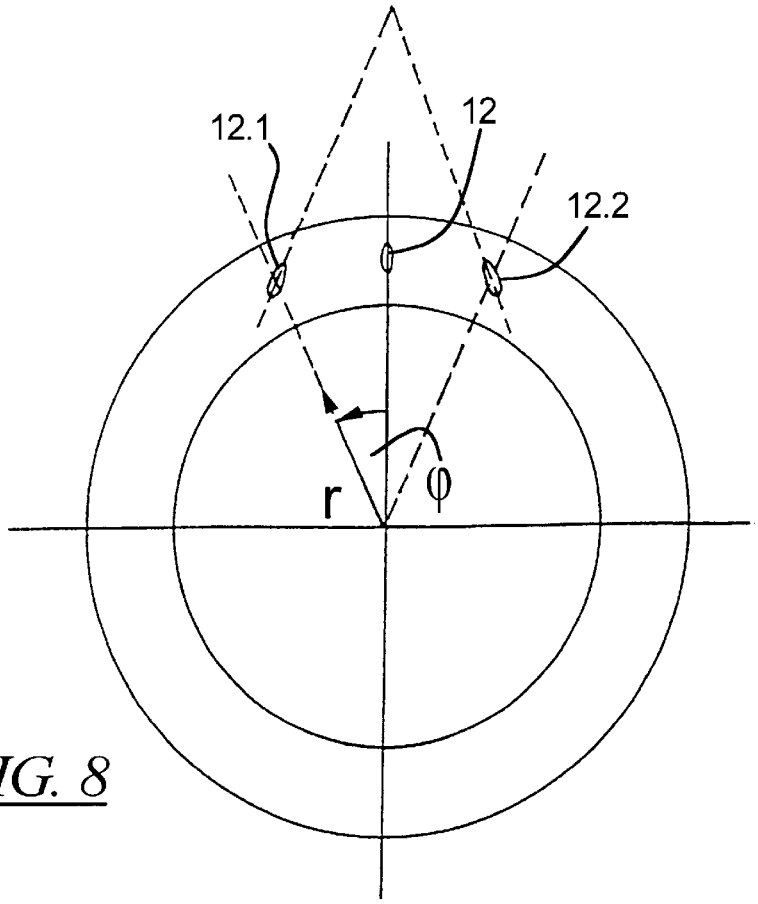
FIG. 8 shows the three focal spots of FIG. 7, of which two are rotated.

The shape of the focal spot 12 can change in an undesired manner, e.g. become wider, during an azimuthal displacement, as a result of non-homogeneities of the respectively resulting magnetic field at the location at which the electron beam 8 passes through the magnetic field of the quadrupole magnetic system 18, causing a degradation of the resolution capacity of an x-ray exposure. To avoid this, the x-ray tube 1 is provided with a coil connected downstream from the quadrupole magnet system 18. This coil is preferably, as in the present embodiment, a solenoid 23. The solenoid 23 produces a suitable magnetic field that influences the electron beam 8 so that the spreading of the electron beam 8, and thus the undesired deformation of the focal spot given an azimuthal displacement of the focal spot 12, for example to the focal spot 12.1 or 12.2, can be counteracted. By means of the magnetic field of the solenoid 23, the focal spots 12, 12.1 and 12.2 can even be rotated in any direction relative to the r coordinate of the polar coordinate system shown in FIG. 7, i.e., the orientation of the focal spots 12, 12.1, 12.2 can be changed relative to the target surface 11. In particular given stereo exposures with two or more focal spots, this allows, by corresponding shaping or rotation of the focal spots relative to the subject to be irradiated, the resolution capacity, as seen from the x-ray detector, of the x-ray exposure allocated to a focal spot to be improved. As an example, FIG. 8 shows how the focal spots 12.1 and 12.2 from FIG. 7 can be rotated by a suitable magnetic field of the solenoid 23 in relation to the r coordinate of the polar coordinate system shown in FIG. 7 and FIG. 8.

Figure 9:
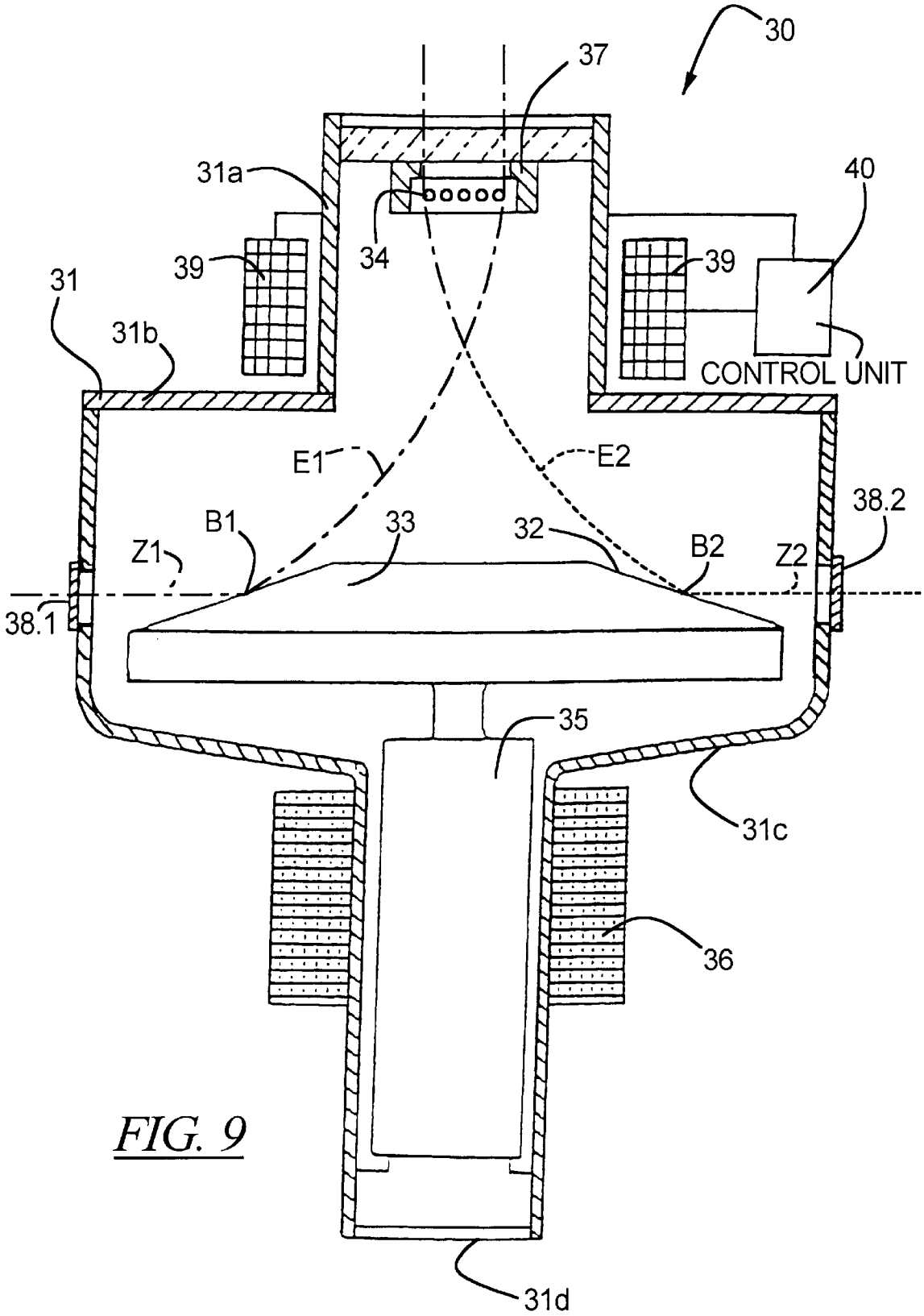
FIG. 9 is a side view, partly in section of an inventive rotating anode x-ray tube with four beam exit windows.

FIG. 9 shows a further embodiment of an inventive x-ray tube 30, which can for example be provided for material investigation. The x-ray tube 30 is fashioned as a rotating-anode x-ray tube, and has a vacuum housing 31 assembled from several parts. In the interior of the vacuum housing 31, the x-ray tube 30 is provided with an anode plate 33 that has a target surface 32, a stationary electron emitter 34 which emits an electron beam with a substantially round cross-section, and a motor for driving the anode plate 33. The motor is fashioned as a squirrel-cage motor, and has a rotor 35 that is connected in rotationally fixed fashion with the anode plate 33, and a stator 36 that is placed on the vacuum housing 31 in the area of the rotor 35. The anode plate 33 and the rotor 35 are mounted rotatably in the interior of the vacuum housing 31 in a known way not shown in more detail.

The vacuum housing 31 is forced by a total of four housing segments 31*a* to 31*d*. In the region at the top in FIG. 9, the vacuum housing 31 is provided with a metallic housing segment 31*a* in which the electron emitter 34 is located, which is housed in the focusing slot of a schematically indicated cathode cup 37. A circular, likewise metallic, housing segment 31*b* is connected to the housing segment 31*a*, this segment 31*b* being connected with a housing segment 31*c*, likewise metallic, that is approximately funnel-shaped and which contains the anode plate 33 and the rotor 35 of the electric motor. The housing segment 31*c* has four beam exit windows 38.1 to 38.4, offset by approximately 90°, of which only the beam exit windows 38.1 and 38.2 are visible in FIG. 9, for x-rays produced during the operation of the inventive x-ray tube 30. The housing segment 31 a is sealed in a known way with a ceramic part at the side of the electron emitter 34, this ceramic part being provided with terminals for the heating voltage of the electron emitter 34.

The fourth housing segment 31*d* of the vacuum housing 31 is a ceramic part of circular construction that is arranged on the funnel-shaped housing segment 31*c* and seals this segment 31*c* in the region of the vacuum housing shown at the bottom of FIG. 9. The housing segments 31*a* to 31*d* are connected with one another in vacuum-tight fashion in a known manner.

The terminals for the tube voltage and the supply voltage for the stator 36 are not shown in FIG. 9 and are constructed in a known manner.

A quadrupole magnet system 39, corresponding to the quadrupole magnet system 18 shown in FIG. 2, is arranged around the housing segment 31*a*, this magnet system 39 serving, as in the previously described embodiment, for the focusing and deflection of an electron beam emanating from the electron emitter 34 during the operation of the x-ray tube 30. As in the previously described embodiment, a control unit 40 for the predetermination of various parameter sets of coil currents is connected to the quadrupole magnet system 39, with which coil currents the coils of the quadrupole magnet system 39 are generated in order to produce a desired magnetic field for the focusing and deflection of the electron beam.

If, during the operation of the x-ray tube 30, the coils of the quadrupole magnet system 39 are charged with coil currents of a first parameter set, the electron beam E1 emanating from the electron emitter 34 strikes a first focal spot B1 located on the target surface 32, which has the shape of a truncated cone, of the anode plate 33. An x-ray bundle, of which only the central ray Z1 is indicated in FIG. 9, emanates from the focal spot B1. The useful x-ray bundle exits from the x-ray tube 30 through the beam exit window 38.1 present in the housing segment 31*c* of the vacuum housing 31. If, in contrast, the coils of the quadrupole magnet system 39 are charged by the control unit 40 with coil currents of a second parameter set, then the electron beam E2 emanating from the electron emitter 34 strikes on a second focal spot B2 located on the target surface 32 of the anode plate 33. In this case, an x-ray bundle, of which only the central ray Z2 is likewise indicated in FIG. 9, emanates from the focal spot B2. The useful x-ray bundle exits the x-ray tube 30 through the beam exit window 38.2 provided in the housing segment 31*c* of the vacuum housing 31. A charging of the coils of the quadrupole magnet system 39 with corresponding parameter sets of coil currents thereby makes it possible to deflect the electron beam emanating from the electron emitter 34 onto two further focal spots B3 and B4, displaced by approximately 90° in relation to the focal spots B1 and, respectively, B2, in a manner not shown in FIG. 9. When the electron beam strikes the target surface 32 of the anode plate 33 respective x-ray beams are produced, one of which exits from the x-ray tube 30 through the beam exit window 38.3 and in the other of which exits through the beam exit window 38.4.

It is thus clear that in the present embodiment four focal spots, offset by approximately 90°, can be produced on the target surface 32 of the anode plate 33 by means of suitable charging of the coils of the quadrupole magnet system 39 with parameter sets of coil currents. When the electron beam strikes the target surface 32 of the anode plate 33 x-ray bundles are produced which exit the x-ray tube 30 through beam exit windows 38.1 to 38.4 allocated to the respective focal spots.

The embodiment shown in FIG. 9 thus does not need an additional coil, connected downstream from the quadrupole magnet system 39, for the shaping and orientation of the electron beam. The x-ray tube 1 shown in FIG. 2 also need not necessarily be provided with a coil of this sort. However, it is also possible for more than a single coil of this sort to be connected downstream from the quadrupole magnet system for the influencing of the electron beam.

The coil connected downstream from the quadrupole magnet system for the influencing the shape and the orientation of the focal spot on the target surface of the anode need not necessarily be a solenoid, but can be a coil of a different construction that produces a suitable magnetic field.

In the case of the embodiment shown in FIG. 9, the number of offset focal spots, or the arrangement of the beam exit windows allocated to the focal spots, is shown only as an example, and can be executed differently. For example, it is also possible to produce more than four focal spots by means of suitable charging of the coils of the quadrupole magnet system with coil currents with corresponding parameter sets, with a beam exit window for the exit of the x-ray bundle from the x-ray tube being allocated to each of the focal spots produced.

The quadrupole magnet system need not necessarily includes only four coils, but rather can comprise be formed of more, e.g. eight, coils, with each coil being charged with a suitable coil current. In this case, for example four coils can be charged with coil currents for the production of the dipole field and four coils can be charged with coil currents for the production of the quadrupole field. A parameter set of coil currents would then comprise eight coil currents.

The inventive x-ray tube has been specified above in relation to the example of a rotating tube and a rotating anode x-ray tube. However, the inventive x-ray tube can also be a fixed-anode x-ray tube.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray tube comprising:

a vacuum housing;

a cathode disposed in said vacuum housing, said cathode emitting electrons;

a circular anode plate in said vacuum housing, said circular anode plate having an annular target surface thereon;

a quadrupole magnet system which emits a magnetic field which interacts with said electrons for focusing and deflecting said electrons to a focal spot on said annular target surface of said circular anode plate, said quadrupole magnet system comprising a plurality of coils respectively operated by a plurality of coil currents; and a control unit connected to said plurality of coils and supplying said plurality of coil currents respectively to said plurality of coils, said control unit having stored therein a plurality of parameter sets for respectively setting different values for the respective coil currents, said control unit activating a selected parameter set to azimuthally displace said focal spot from a first location to a predetermined, second location spaced from said first location on said annular target surface of said circular anode plate.

2. An x-ray tube as claimed in claim 1 further comprising at least one additional coil disposed downstream from said quadrupole magnet system between said cathode and said anode, said at least one further coil generating a magnetic field for selectively varying a shape of said focal spot and an orientation of said focal spot relative to said target surface.

3. An x-ray tube as claimed in claim 2 wherein said at least one additional coil comprises a solenoid.

4. An x-ray tube as claimed in claim 1 wherein said vacuum housing comprises at least two x-ray beam exit windows, respectively disposed for allowing x-rays respectively emanating from said first and second locations of said focal spot on said target surface to exit said vacuum housing.

5. An x-ray tube as claimed in claim 1 wherein said vacuum housing comprises an annular x-ray beam exit window for allowing x-rays respectively emanating from said first and second locations of said focal spot to exit said vacuum housing.

6. An x-ray tube as claimed in claim 1 further comprising means for rotating said vacuum housing around a rotational axis, with said cathode and said anode being fixedly connected in said vacuum housing.

7. An x-ray tube as claimed in claim 6 wherein said cathode is disposed in said vacuum housing so that said straight line propagation path substantially coincides with said rotational axis.

* * * * *